US009045910B2

(12) United States Patent
Price

(10) Patent No.: US 9,045,910 B2
(45) Date of Patent: Jun. 2, 2015

(54) CLIP AND METHOD FOR THE MOUNTING OF PANELS

(75) Inventor: Gary Michael Price, Bishop's Stortford (GB)

(73) Assignee: THE PLASTERBOARD CLIP COMPANY LTD (GB)

( * ) Notice: Subject to any disclaimer, the term of this patent is extended or adjusted under 35 U.S.C. 154(b) by 820 days.

(21) Appl. No.: 13/139,840

(22) PCT Filed: Dec. 14, 2009

(86) PCT No.: PCT/GB2009/002876

§ 371 (c)(1),
(2), (4) Date: Sep. 2, 2011

(87) PCT Pub. No.: WO2010/070268

PCT Pub. Date: Jun. 24, 2010

(65) Prior Publication Data

US 2012/0037779 A1 Feb. 16, 2012

(30) Foreign Application Priority Data

| | | |
|---|---|---|
| Dec. 15, 2008 | (GB) | 0822786.0 |
| Oct. 26, 2009 | (GB) | 0918818.6 |
| Nov. 12, 2009 | (GB) | 0919772.4 |

(51) Int. Cl.
*E04G 5/06* (2006.01)
*E04F 21/18* (2006.01)

(52) U.S. Cl.
CPC ..... *E04F 21/185* (2013.01); *Y10T 29/49815* (2015.01)

(58) Field of Classification Search
CPC ..... E04B 9/30; E04F 21/185; Y10T 29/49815
USPC ..... 248/226.11, 227.4, 228.7, 231.81, 903, 248/909; 52/489.1, 514, 714, 770
See application file for complete search history.

(56) References Cited

U.S. PATENT DOCUMENTS

| | | | | |
|---|---|---|---|---|
| 2,851,740 | A * | 9/1958 | Baker | 52/479 |
| 4,377,060 | A * | 3/1983 | Ragland | 52/489.2 |
| 4,621,473 | A * | 11/1986 | Wendt | 52/489.2 |
| 4,995,605 | A * | 2/1991 | Conville | 52/770 |
| 8,011,153 | B2 * | 9/2011 | Orchard | 52/489.1 |

OTHER PUBLICATIONS

PCT International Application No. PCT/GB2009/002876, International Search Report dated May 26, 2010.

* cited by examiner

*Primary Examiner* — Gwendolyn W Baxter
(74) *Attorney, Agent, or Firm* — Kane Kessler, P.C.; Paul E Szabo

(57) ABSTRACT

In a system for mounting panels, a plurality of clips (14) is distributed at spaced intervals along an edge of a first panel (12A), respective first planar limbs of the clips (14) are located, parallelly to the panel (12A) between the panel (12A) and a structural support (10) for the panel (12A) and an edge of a second panel is brought up to the clips (14) to support the edge of the second panel (12B) on respective second planar limbs of the clips (14) parallelly to the second panel (12B). The system may also make provision for circumstances in which a first panel is not available.

12 Claims, 4 Drawing Sheets

CLIP AND METHOD FOR THE MOUNTING OF PANELS

This invention relates to the mounting of panels, for example the mounting of plasterboard panels on the undersides of beams.

When plasterboarding a ceiling, in most cases each panel is balanced on the head and is pushed into position with both hands and then held there by the forehead and one hand until a permanent fixing can be achieved with the other hand. This is a difficult procedure, since the stability of holding by the forehead and one hand is poor and the builder's range of visibility is very poor, so it is difficult to manoeuvre the board into the correct position before fixing and to keep it there during fixing.

GB-A-2341400 discloses a method of mounting plasterboard panels in which a first panel adjacent a wall is nailed to the undersides of transverse ceiling joists, then a generally I-section support strip extending over the whole of the length of the panel is fitted to the longitudinal edge of the panel further from the wall, so as to embrace that edge between upper and lower limbs of the I-section. Thereafter, a longitudinal edge of a second plasterboard panel is inserted between those upper and lower limbs of the I-section at the opposite side of the web of the I-section to the first panel and the second panel is then nailed to the joists.

According to one aspect of the present invention, there is provided a clip for use in mounting a panel relative to a support, comprising a limb which is anchorable relative to said support and upon which an edge zone of said panel is to bear temporarily, said limb being readily removable from connection with said support.

According to a second aspect of the present invention, there is provided a method comprising anchoring relative to a support a limb of a clip, bringing an edge zone of a panel to bear upon said limb, fixing said panel relative to said support, and thereafter removing said limb.

Owing to those aspects of the present invention, not only is there a saving of material by use of a plurality of clips rather than long l-section strips, but also the clips are easier to handle in comparison with long strips and, moreover, the removal of the temporarily bearing limbs can leave a smooth, overall, undersurface for the panels.

Advantageously, such clip may have, on the same side of a web as a first planar limb, a third planar limb substantially co-planar with a second planar limb (thus, the clip could be of an "h" cross-sectional form), so that the clip embraces a supporting panel. In a preferred embodiment, the clip has a fourth planar limb at the opposite side of the web from the second and third limbs and co-planar with the first limb, so that the clip is of an "I" cross-sectional form. The second and third planar limbs may have beneath them a reinforcing bracket arrangement to increase the load-bearing capacity of those limbs.

According to a fourth aspect of the present invention, there is provided a clip for use in mounting a panel and comprising a first limb for anchoring said clip relative to a support, and a second limb against which an edge zone of said panel is to bear, said first limb being readily removable from connection with said second limb.

According to a fifth aspect of the present invention, there is provided a method comprising anchoring relative to a support a first limb of first and second limbs of a clip, bringing an edge zone of a panel to bear upon the second limb, fixing said panel relative to said support, and thereafter removing said first limb.

According to a sixth aspect of the present invention, there is provided a clip having a first planar limb for location, parallelly to a first panel, between the panel and a structural support for the panel, a second planar limb for supporting a second panel parallelly to said first panel, and a web interconnecting the first limb and the second limb and transverse to the planes of the first and second limbs.

According to a seventh aspect of the present invention, there is provided a method comprising distributing a plurality of clips at spaced intervals along an edge of a first panel, locating respective first planar limbs of the dips, parallelly to the panel, between the panel and a structural support for the panel, and bringing an edge of a second panel up to said clips to support said edge of said second panel on respective second planar limbs of said clips parallelly to said second panel.

In order that the invention may be clearly and completely disclosed, reference will now be made, by way of example, to the accompanying drawings, in which.

Figure 1:
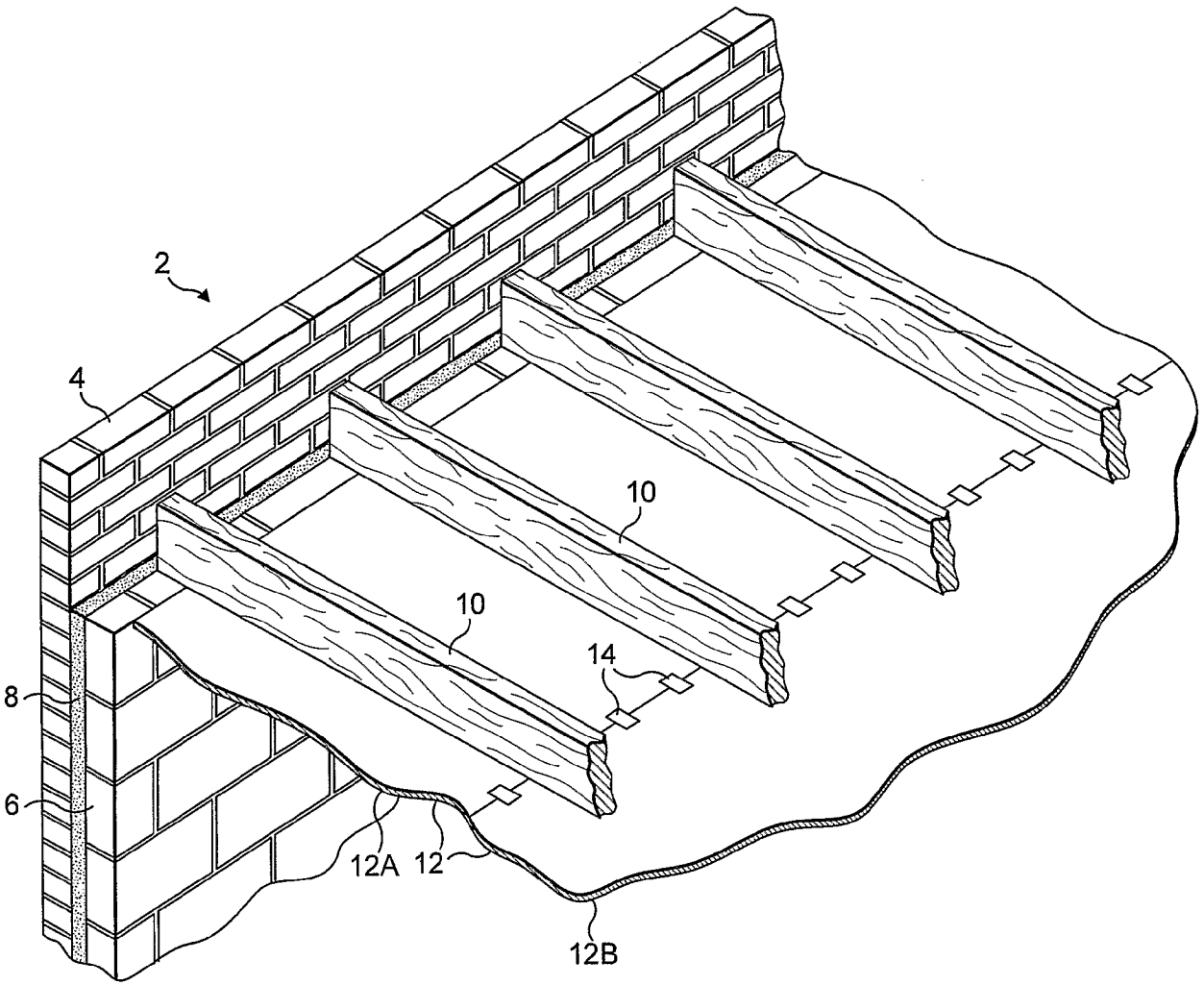
FIG. 1 is a top perspective view of part of the ceiling of a building in the course of construction in which plasterboard panels are secured to the undersides of joists.

Referring to FIG. 1, there is seen a cavity wall 2 comprising an outer brick skin 4 and an inner breeze block skin 6 separated by a layer of insulation 8. Spaced, parallel, horizontally extending floor joists 10 are supported at respective ends in the inner skin 6 of the wall 2 and plasterboard panels 12 are secured to the undersides of the joists by nails.

Figure 2:
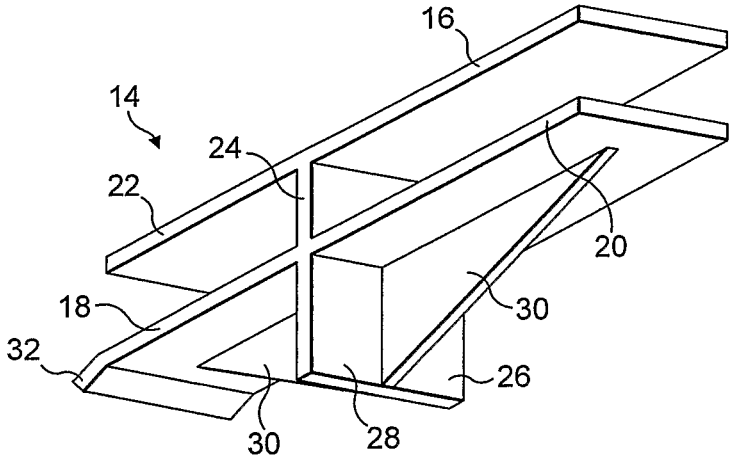
FIG. 2 is an underneath perspective view of one of a plurality of identical clips used in temporarily supporting plasterboard panels in the ceiling.
Figure 3:
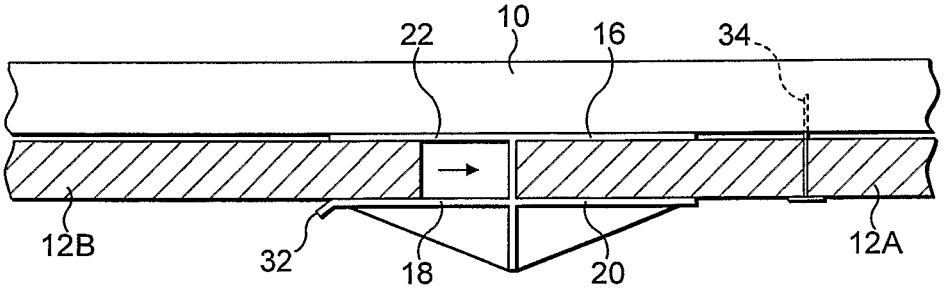
FIGS. 3 to 5 are end elevations illustrating respective stages in the use of one such clip.

Referring to FIG. 2, the clip 14 has first, second, third and fourth planar limbs 16 to 22 and a central web 24, so forming an I-section. In order to increase the load-bearing capabilities of the limbs 18 and 20, the clip includes a bracket arrangement 26 consisting of an extension 28 of the web 24 and two triangular brackets 30 extending from the extension 28 longitudinally of the limbs 18 and 20. The free end zone 32 of the limb 18 extends obliquely outwardly away from the limb 22.

Figure 4:
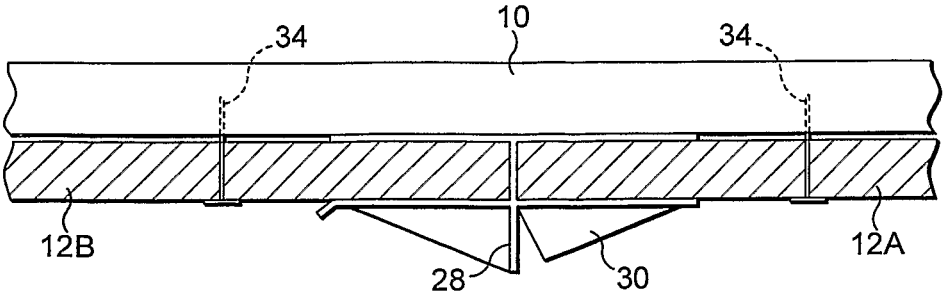
Figure 5:
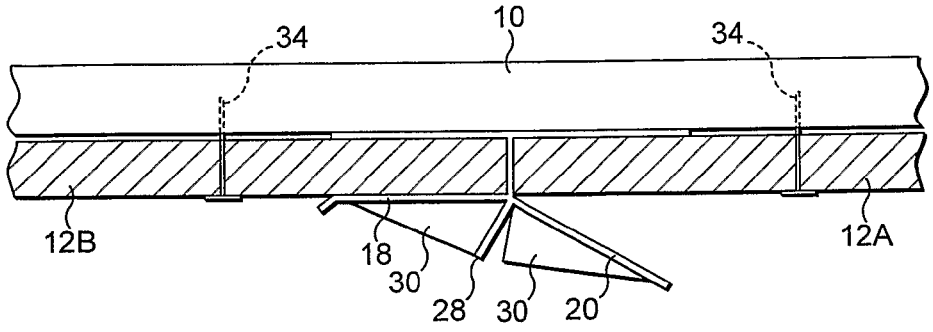

In fixing the plasterboard panels to the undersides of the joists 10, first of all a panel 12A is butted up against a corner of the skin 6 and is nailed to the undersides of the joists 10. The panel 12A is not nailed up fully, so as to leave gaps between the undersides of the joists 10 and that longitudinal edge zone of the panel 12A not beside the skin 6. Then a plurality of clips 14 are caused to embrace that longitudinal edge zone at intervals therealong; when that has been done, the nails, such as 34, for the panel 12A are fully nailed in. Then a second plasterboard panel 12B has a longitudinal edge zone thereof inserted between the limbs 18 and 22 of the clips 14, the downwardly oblique free end zone 32 aiding introduction of the longitudinal edge of the panel 12B into the clip. This can be performed by the builder's using his head and both hands to place the panel 12B into the clips 14 and to manoeuvre the panel 12B into the correct position. Once that has been done, that longitudinal edge zone of the panel 12B without clips is nailed to the joists 10, leaving both hands free for nailing of the clipped longitudinal edge zone to the joists 10. Thus, during fixing of the panel 12B, the builder does not need to support the panel with his forehead, so a good range of visibility can be maintained to ensure that the board is in the correct position during fixing. In the next stage, illustrated in FIG. 4, one of the triangular brackets 30 (it does not matter which one) is severed from the extension 28 and the limb above it (in this case the limb 20 is pulled down) (this stage is seen in FIG. 5). This allows access to the junction between the web 24 and the limbs 18 and 20 for severing the web 24 along its lower edge, thus leaving in position the limbs 16 and 22 and the web 24, so that the clip no longer interrupts the plane of the lower surfaces of the plasterboard panels. The clips 14 are of moulded plastics and are strong enough to take at least part of the weight of a plasterboard panel, but can also be cut easily with a builder's knife after the permanent fixing has been achieved. Such clips can also be used in plasterboarding a wall, but then the bracket arrangement 26 can probably be dispensed with and it may also be possible to dispense with the limb 22 and maybe even the limb 20. Again, the web 24 would be severed at its edge furthest from the wall.

It will be understood that, once a corner panel has been fixed in position, the area to be plasterboarded can be covered by simply using the exposed longitudinal and transverse edges one after another for support of the clips. If the wall or ceiling is to be double-boarded, the process is simply repeated.

Figure 6:
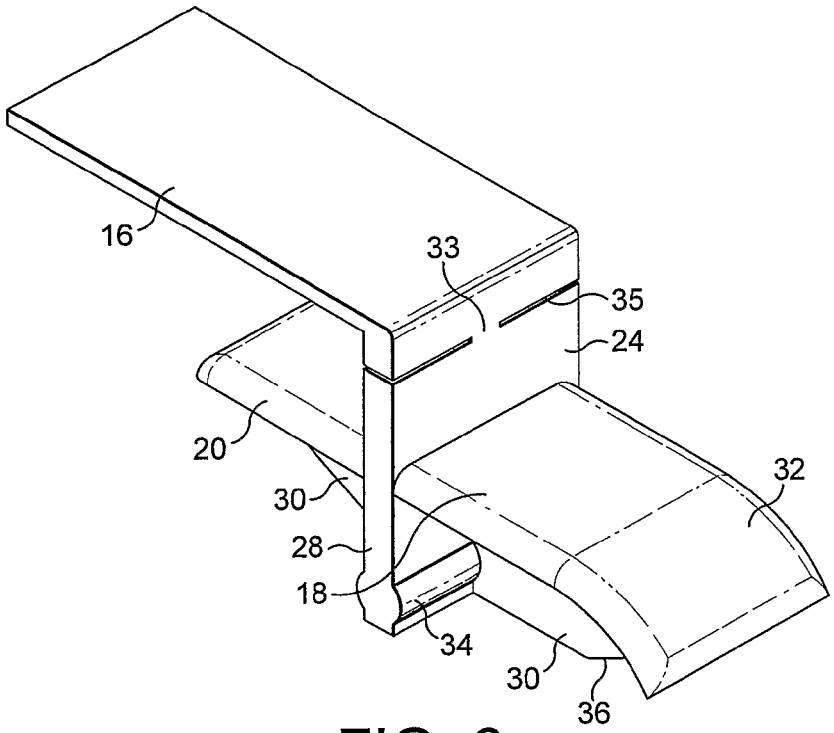
FIG. 6 is a top perspective view of a modified version of such clip.
Figure 7:
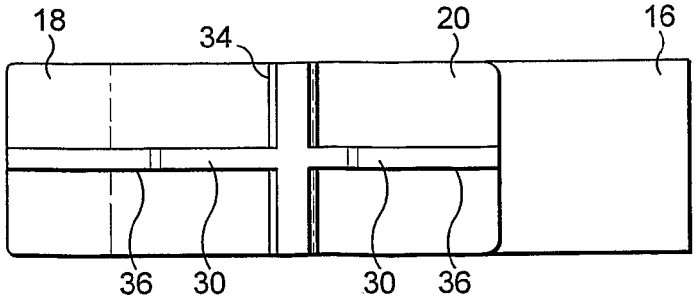
FIG. 7 is an underneath plan view of the modified version.

The version shown in FIGS. 6 and 7 differs from that shown in FIG. 2 chiefly in that the limb 22 is omitted and in that the limbs 18 and 20 are removed by being knocked away rather than cut off. This enables the location of division of the clip to be higher up the web 24 (and thus less likely to protrude below the bottom surfaces of the plasterboards; whilst more removed plastics is available for recycling). For this purpose the web 24 has a transverse slit 35 therethrough across which extends a frangible bridge 33 which is broken when, for example, the lower part of the web 24 is struck with a hammer swung in a vertical plane to deliver a blow to a vertical edge of the web. To increase the effectiveness of the hammer blow, particularly to avoid its simply breaking away that edge, the lowermost edge of the web 24 is reinforced by a moulded thickening 34. Instead of the brackets 20 being triangular, they are more of an oblong rectangular form with chamfered lower outer corners 36 and thus giving somewhat better support for the plasterboard prior to fixing.

In use of clips according to FIGS. 6 and 7 (clips according to FIG. 2 are also usable in a corresponding manner), referring to FIG. 1, all of the clips have their limbs 16 inserted between the panel 12A and the bottom surfaces of the joists 10, so that the clips are held in position. Then the panel 12B has an edge slotted in between the joists 10 and the limbs 18 and is then nailed to the joists, with the added advantage that the locations of the joists for that nailing are indicated by the clips. Following that nailing, the lower parts of the clips are knocked away, as explained above.

Figure 8:
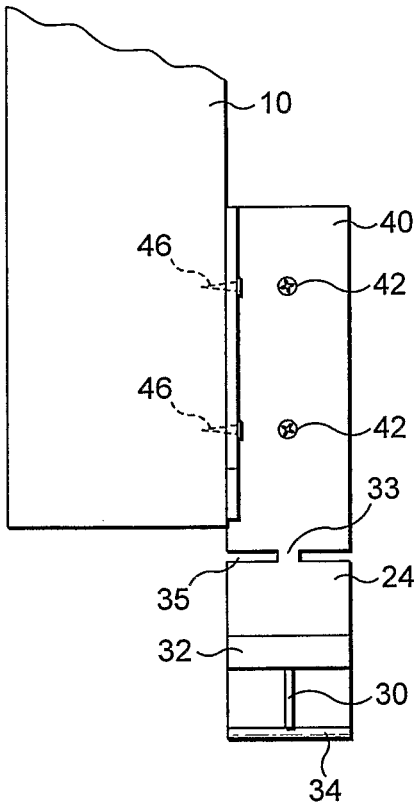
FIG. 8 is a fragmentary front elevation of another modified version of such clip attached to a side face of a joist.
Figure 9:
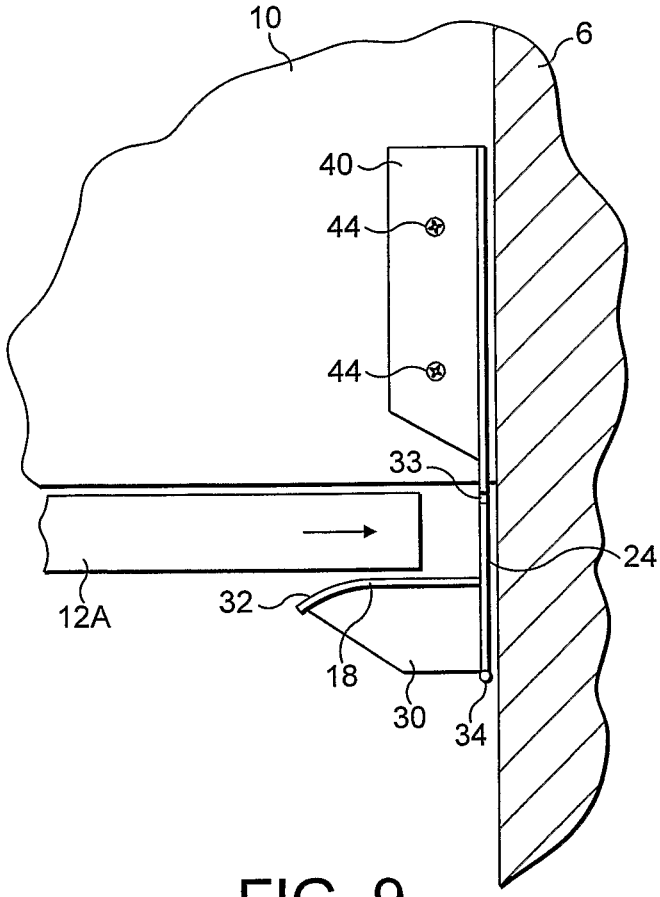
FIG. 9 is a fragmentary side elevation of that other modified version attached to the joist.

The version shown in FIGS. 8 and 9 differs from the other two versions in that it has been designed specifically to facilitate the mounting of a corner panel, such as the panel 12A in FIG. 1, to some supporting arrangement, such as the joists 10. This version again includes the limb 18 and the web 24, with the bracket 30 and the frangible bridge 33, the moulded thickening 34 and the transverse slit 35. However, the web 24 extends beyond the slit 35 to provide a limb 40 of L-shaped cross section. Each side of the cross-section is formed with a pair of fastening locations (for example, through holes) 42 or 44.

In use, the fastening locations 44 can be employed in attaching one side of the limb 40, by means of screws, nails or self-taps 46, to a side face of the joist 10, with the web 24 and the other side of the limb 40 being placed against the skin 6. Then, as illustrated in FIG. 9, the panel 12A can be brought to bear with an edge zone on the limb 18 (it will of course be understood that there would normally be a plurality of clips similarly fixed to a plurality of joists 10 along the skin 6 in order to bear the edge zone of the panel 12A). After the panel 12A has been nailed to the undersides of the joists 10, the lower part of the clip can be broken away with a hammer, again through breaking the frangible bridge 33.

The fastening locations 42 are provided in order to enable the clip to be fastened to the skin 6 should that be desired.

The invention claimed is:

1. A clip for use in mounting a panel and comprising a first limb for use in anchoring said clip relative to a support and a second limb against which an edge zone of said panel is to bear, said second limb being readily removable from connection with said first limb, said clip further comprising a web interconnecting said first limb and said second limb and transverse to those two limbs and yet further comprising a third limb extending from said web in the same direction as said first limb and substantially co-planar with said second limb and at that side of said web opposite to said second limb, whereby said first limb and said third limb serve to receive between them an edge of another panel.

2. A clip according to claim 1, wherein the first, second and third limbs and said web give said clip a basically "h" profile.

3. A clip according to claim 1 wherein the ready removability of said second limb from connection with said first limb is achieved through said web having a frangible bridge effective between said first limb and said second limb and nearer to said first limb than to said second limb.

4. A clip for use in mounting a panel and comprising a first limb for use in anchoring said clip relative to a support and a second limb against which an edge zone of said panel is to bear, said second limb being readily removable from connection with said first limb, said clip further comprising a web interconnecting said first limb and said second limb and transverse to those two limbs and yet further comprising a reinforcement of said second limb at the opposite side of said second limb from said web.

5. A clip according to claim 4, wherein said reinforcement comprises an extension of said web.

6. A clip according to claim 5, wherein said reinforcement comprises a bracket between said extension and said second limb.

7. A clip according to claim 6, wherein said bracket is more oblong rectangular than triangular in form.

8. A clip according to claim 5, and further comprising a strengthening of said extension effective against hammer blows, said strengthening comprising an enlargement of an outer end of said extension.

9. A clip according to claim 4 wherein the ready removability of said second limb from connection with said first limb is achieved through said web having a frangible bridge effective between said first limb and said second limb and nearer to said first limb than to said second limb.

10. A clip for use in mounting a panel and comprising a first limb for use in anchoring said clip relative to a support and a second limb against which an edge zone of said panel is to bear, said second limb being readily removable from connection with said first limb, said clip further comprising a web interconnecting said first limb and said second limb and transverse to those two limbs, yet further comprising a third limb extending from said web and substantially co-planar with said second limb and at that side of said web opposite to said second limb, whereby said first limb and said third limb serve to receive between them an edge of another panel, and even further comprising a reinforcement of said second limb at the opposite side of said second limb from said web, said reinforcement comprising an extension of said web, being also of said third limb and including a bracket between said extension and said third limb.

11. A clip according to claim 10 wherein said bracket is more oblong rectangular than triangular in form.

12. A clip according to claim 10 wherein the ready removability of said second limb from connection with said first limb is achieved through said web having a frangible bridge effective between said first limb and said second limb and nearer to said first limb than to said second limb.

* * * * *